US006227847B1

(12) United States Patent
Gillespie

(10) Patent No.: US 6,227,847 B1
(45) Date of Patent: May 8, 2001

(54) APPARATUS AND PROCESS FOR REMOVING VOLATILE COATINGS FROM SCRAP METAL

(75) Inventor: John R. Gillespie, St. Louis County, MO (US)

(73) Assignee: Gillespie & Powers, Inc., St. Louis, MO (US)

( * ) Notice: Subject to any disclaimer, the term of this patent is extended or adjusted under 35 U.S.C. 154(b) by 0 days.

(21) Appl. No.: 09/130,216

(22) Filed: Aug. 6, 1998

(51) Int. Cl.[7] ..... F23J 17/00

(52) U.S. Cl. ..... 432/72; 432/106; 110/236

(58) Field of Search ..... 432/13, 72, 103, 432/105, 106; 110/246, 203–207, 210, 211, 214, 236; 134/19, 38, 40

(56) References Cited

U.S. PATENT DOCUMENTS

| | | | | |
|---|---|---|---|---|
| 3,604,824 | * | 9/1971 | Hardison | 432/72 |
| 4,548,651 | | 10/1985 | Ramsey . | |
| 4,681,535 | | 7/1987 | Kobari et al. . | |
| 5,059,116 | | 10/1991 | Gillespie et al. . | |
| 5,186,622 | | 2/1993 | Gillespie et al. . | |

FOREIGN PATENT DOCUMENTS

| | | |
|---|---|---|
| 0253596A1 | 1/1988 | (EP) . |
| 1578689 | 11/1980 | (GB) . |
| 2104634A | 3/1983 | (GB) . |

OTHER PUBLICATIONS

Waste heat Recovery in Aluminum Scrap Recycling pp 191–199—before 1989.
Thermcon Ovens B.V.–advertisement—before 1994.

* cited by examiner

*Primary Examiner*—Jiping Lu
(74) *Attorney, Agent, or Firm*—Polster, Lieber, Woodruff & Lucchesi, L.C.

(57) ABSTRACT

A system for removing volatile coatings from scrap aluminum, such as expended beverage cans, includes a kiln, a fan for generating an airstream, an afterburner for heating the airstream, and ducting for confining the airstream in a closed loop so that it circulates through the afterburner, the kiln and back to the fan in that order. The ducting includes a bypass duct into which a portion of the airstream is diverted at a diverter value, before being heated by the afterburner. This portion reenters the heated portion of the airstream downstream from the afterburner and serves to modulate the temperature of the airstream entering the kiln. Indeed, the diverter valve responds to a temperature sensor where the airstream enters the kiln and maintains the temperature at that location constant. That temperature is hot enough to volatilize coatings on the aluminum, yet not hot enough to melt the aluminum. As it passes through the kiln the airstream possesses a diminished oxygen content, so that the volatilized coating does not ignite. The fan responds to another temperature sensor located where the airstream leaves the kiln such as to vary the mass flow, so that the temperature of the airstream leaving the kiln likewise remains constant. A collector exists in the ducting, between the kiln and the fan, and should its surfaces become cool enough to condense the volatilized coatings on them, the system recirculates some of the heated airstream to the collector to maintain the airstream entering it above a prescribed temperature.

12 Claims, 1 Drawing Sheet

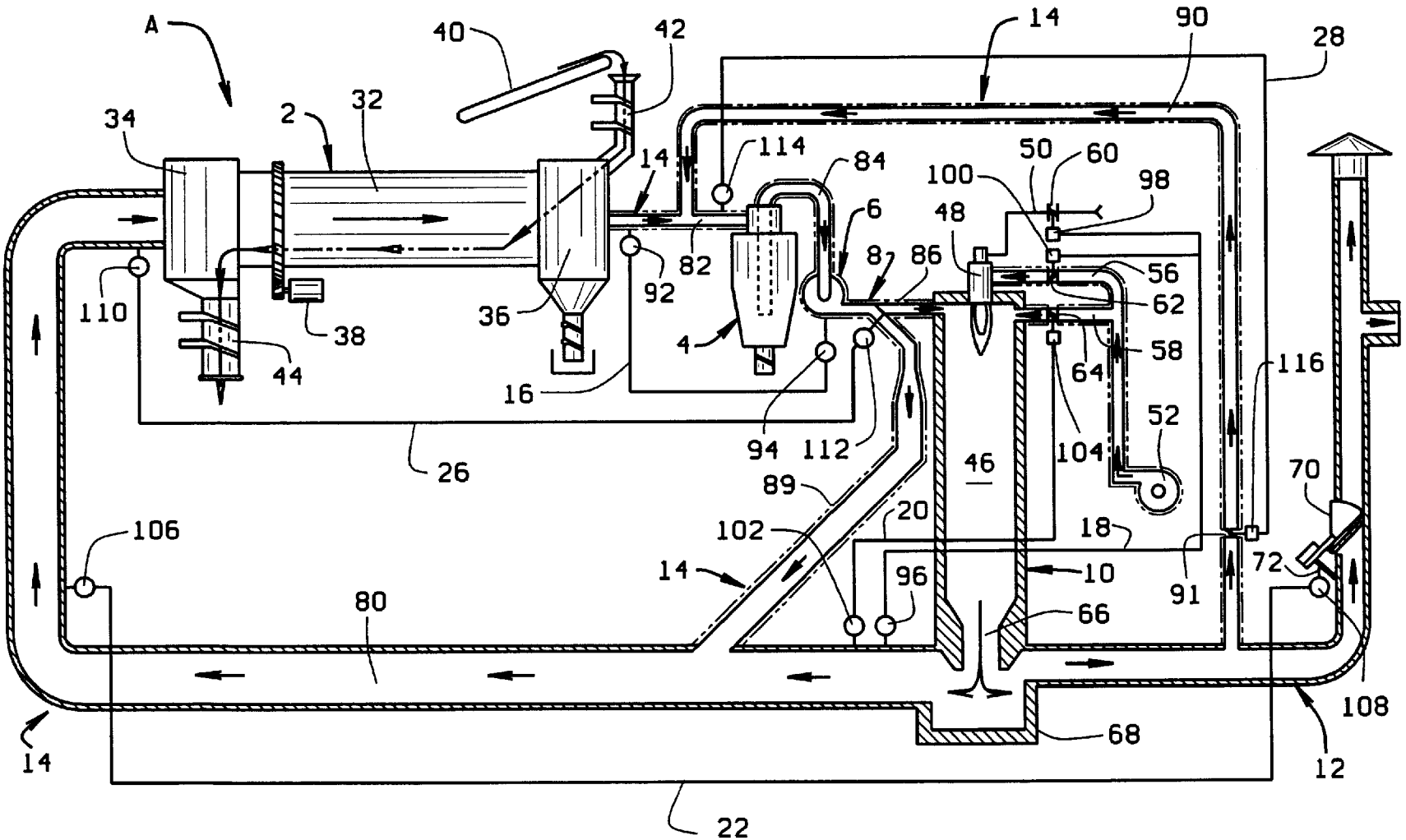
28
90
14
42
40
32
2
A
34
110
26
16
36
4
114
82
92
14
84
6
87
86
100
48
50
60
98
56
62
58
52
64
104
18
10
66
68
12
108
70
72
116
91
46
20
96
112
94
89
102
14
22
80
106
38
44
14

APPARATUS AND PROCESS FOR REMOVING VOLATILE COATINGS FROM SCRAP METAL

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

This application relates in general to processing metals and more particularly to an apparatus and process for removing volatile coatings from scrap metal.

Because the energy required to melt aluminum metal is considerably less than that required to extract aluminum from its ores, much of the aluminum used in manufactured goods derives from aluminum scrap—and one of the principal sources of aluminum scrap is discarded beverage cans. The typical aluminum beverage can has an organic coating, usually a lacquer, on its interior and exterior surfaces, and this coating causes a considerable amount of dross when aluminum cans are introduced into a melting furnace. In this regard, within the furnace the coating volatilizes and ignites before the can melts, and the combustion which ensues oxidizes the aluminum, thereby creating the dross which is actually an oxide of aluminum. Processors of aluminum scrap therefore usually subject aluminum beverage cans to a delacquering operation before introducing them into a melting furnace. Also, beverage cans may contain residual moisture, perhaps in the form of the beverage itself, and to ensure the safety of those operating the melting furnace, the moisture should be eliminated before the cans enter the furnace.

U.S. Pat. No. 5,059,116 and 5,186,622 disclose a system for removing volatile coatings from aluminum beverage cans while keeping dross to a minimum. Basically, the system heats the aluminum scrap in a rarefied airstream—one without enough oxygen to support combustion of the volatile coating—so that the coating volatilizies and enters the airstream. Further downstream, the volatile components in the airstream are mixed with outside combustion air and ignited to rid airstream of the volatile components and to further elevate the temperature of the airstream. The system maintains control of the critical temperature in the kiln by varying the mass flow of the air through the kiln. Not only does the temperature of the airstream remain constant where the air enters the kiln, but so does the temperature gradient of the airstream within the kiln. To control the temperature of the airstream at its entrance to the kiln, the system includes a heat exchanger which extracts heat from the airstream, thereby lowering its temperature to an acceptable magnitude at the entrance to the kiln. To be sure, the heat extracted is used to heat the combustion air that sustains the combustion of the volatiles in the airstream, but even so, the heat exchanger increases the cost of the system and increases its complexity.

BRIEF SUMMARY OF THE INVENTION

The present invention resides in a process and apparatus wherein an airstream of reduced oxygen content circulates along coated scrap metal, such as aluminum, in a kiln. The temperature of the airstream where it first encounters the scrap remains constant, this being by reason of the diversion of the airstream from its cooler regions directly to its heated regions, with the diversion being modulated. The temperature gradient of the airstream in the presence of the scrap remains constant by controlling the mass flow of the airstream over the scrap. The invention also consists in the parts and in the arrangements and combinations of parts hereinafter described and claimed.

BRIEF DESCRIPTION OF THE DRAWINGS

The drawing represents a schematic view of a system, constructed in accordance with and embodying the present invention for removing volatile coatings from aluminum scrap.

DETAILED DESCRIPTION OF THE INVENTION

Referring now to the drawing, a system A for removing volatile coatings from scrap metal, such as aluminum, includes several basic components, namely a kiln 2, a cyclone collector 4, a recirculation fan 6, a diverter valve 8, an afterburner 10, and a system exhaust 12, all of which are connected together by a ducting 14 which confines an airstream that passes through the kiln 2, cyclone collector 4, fan 6, valve 8 and afterburner 10. In addition, the system A has six control loops 16, 18, 20, 22, 26 and 28 which regulate the fan 6, diverter valve 8, afterburner 10, and system exhaust 12 to maintain prescribed conditions in the airstream where it passes through the kiln 2, for it is within the kiln 2 that the airstream encounters the scrap. Those conditions must be such that the coating volatilizes without igniting and such that the aluminum does not melt.

To this end, the airstream enters the kiln 2 at a prescribed temperature, preferably 1100° F. and leaves at a prescribed temperature, preferably 300° F., so that the temperature gradient within the kiln 2 does not vary, even though the mass of the scrap within the kiln 2 and the moisture content of that scrap may vary. Moreover, within the kiln 2 the oxygen content of the airstream remains below that required to support combustion of the volatile coating. This requires an oxygen content not greater than about 6% to 8% by weight. Typically, the scrap consists primarily of aluminum beverage cans in which the aluminum, having been drawn and ironed in the formation of the can, is quite thin. For its mass, each can has a large surface area, and this surface is covered with a protective coating, that volatilizes at elevated temperatures, lacquer being a typical coating. But if the coating ignites, it will usually ignite the thin aluminum which it covers, thereby transforming the aluminum into worthless dross. The airstream where it passes through the kiln 2 volatilizes the coating, but does not consume it or melt it.

The kiln 2 includes a cylinder 32 and two hoods 34 and 36 between which the cylinder 32 rotates. The airstream enters the cylinder at the hood 34 and leaves at the hood 36. The scrap aluminum, on the other hand, enters the cylinder 32 through the hood 36, and leaves through the hood 34. To facilitate the movement of the scrap aluminum through the kiln 2, the cylinder 32 should slope slightly downwardly from the hood 36 to the hood 34. The cylinder 32 is coupled to a motor 38 which rotates it at between 3 and 10 rev/min. The aluminum scrap is delivered to the charge hood 36 by a conveyor 40, and by reason of an air lock 42 at the hood 32 enters the hood 36 and then the cylinder 32 without disrupting the pressure within the kiln 2. The scrap leaves the kiln 2 through another air lock 44 at the discharge hood 34. The ducting 14 leads into the hood 34 and out of the hood 36, the interiors of which are isolated from the surrounding atmosphere, yet open into the interior of the cylinder 32 where seals are located to maintain the isolation. This also preserves the rarefied character of the airstream in the kiln 2 and further enables the airstream to exist at a pressure slightly greater than atmospheric.

The cyclone collector 4 is conventional, and as such has a conical wall. The airstream upon entering the collector 4 acquires a high velocity along the conical wall. As a consequence, particulates that are entrained in it are flung outwardly toward the wall and then gravitate to the bottom of the collector 4 where they accumulate. They are removed periodically from the bottom of the collector 4.

The circulation fan 6 gives velocity to the airstream and thus propels it though the ducting 14 and the kiln 2, cyclone collector 4 and afterburner 10. It has the usual housing with a suction port at its center and a tangential discharge port. The fan 6 also has variable speed motor for controlling the velocity of the airstream and hence the mass flow of air through the ducting 14 and the kiln 2.

The diverter valve 8 lies within the ducting 14 immediately beyond the circulation fan 6, and it proportions the airstream so that some of it flows to the afterburner 10 and the rest bypasses the afterburner 10. Indeed, the proportionment is such that the temperature of the airstrean at the entrance to the kiln 2 remains generally constant, preferably at 1100° F.

The afterburner 10 heats the airstream so that it enters the kiln 2 at an elevated temperature. It also consumes the volatile components of the coating that are removed from the scrap metal. Much of the heat required for elevating the temperature of the airstream comes from the volatile components themselves which are burned in the afterburner 10, but other and more conventional fuel is supplied to the afterburner 10 to supplement and sustain the combustion of the volatile components. The ducting 14 connects to the afterburner 10 at two locations.

The afterburner 10 includes a combustion chamber 46 which is oriented vertically and is lined with a refractory. The airstrean enters the chamber 46 at its upper end, the airstream being forced through the ducting 14 and into the chamber 46 by the circulation fan 6. The upper end of the chamber 46 also has a burner 48 directed into it, and it is connected to a fuel line 50 which is in turn connected to a source of gaseous fuel, such as natural gas. The burner 48 discharges the gaseous fuel into the combustion chamber 46 along with enough combustion air to support combustion of the fuel. That combustion air derives from a combustion blower 52, the discharge port of which is connected to the burner 48 through a supply duct 54 which divides into two branches 56 and 58, the former leading to the burner 48 and the latter to the upper end of the combustion chamber 46 in the region of the burner 48. The fuel line 50 contains a motor-operated valve 60. The burner branch 56 of the air supply duct 54 contains a motor-operated damper 62 which controls the amount of air passing through it to the burner 48. Likewise, the combustion chamber branch 58 contains a motor-operated damper 64 which controls the amount of air passing through it to the combustion chamber 46. Thus, the blower 52 forces combustion air into both the burner 48 and the upper end of the combustion chamber 46. The air delivered to the burner 48 through the branch 56 mixes with the gaseous fuel introduced to the burner 48 through the fuel line 50 and thus supports combustion of the fuel. The air delivered to the combustion chamber 46 through the branch 58 elevates the oxygen content of the airstream enough to support combustion of the volatilize components of the coating.

The afterburner 10 at the lower end of its combustion chamber 46 contains a throat 66 and below the throat 66 has a separator 68. The throat 66 establishes communication between the combustion chamber 46 and the separator 68. Basically, the airstream undergoes an increase in velocity in the throat 66 and then a sudden reduction in velocity in the separator 68. The reduction in velocity separates particulates from the airstream so the separator 68 supplements the cyclone collector 4 in ridding the airstream of particulates.

The system exhaust 12 is connected to the separator 68 at the lower end of the afterburner 10 and is lined with a refractory. It contains a mechanical damper 70 which is operated by an electrical control motor 72. Beyond the damper 70 the system exhaust 12 is vented to the atmosphere or to a bag house.

The separator 68 at the bottom of the afterburner 10, through of the ducting 14, also communicates to the inlet of the kiln 2. In this regard, the ducting 14 contains a supply duct 80 which extends from the separator 68 of the afterburner 10 to the discharge hood 34 of the kiln 2. Since the duct 80 conveys the airstream when it is at its highest temperature and greatest volume, the duct 80 has the largest cross-section of any of the ducting 14. Moreover, it is lined with a refractory. After all, the airstream leaves the afterburner 10 near 1500° F. to 1600° F., and when it reaches the kiln 2, it still is as high as 1100° F.

At the other end of the kiln 2, a much smaller discharge duct 82 leads from the charge hood 36 to the cyclone collector 4, and it of course delivers the much cooler airstream to the collector 4. The airstream leaves the collector 4 through another discharge duct 84 which leads to the suction port of the circulation fan 6. The discharge port of the fan 6 opens into a return duct 86 which leads to the afterburner 10, opening into the upper end of the combustion chamber 46 near the burner 48. The discharge ducts 82 and 84 and the return duct 86 also constitute part of the ducting 14. The diverter valve 8 lies within the return duct 84 where it diverts some of the airstream into a bypass duct 88, which also constitutes part of the ducting 14, with the amount diverted being dependent on the setting of the valve 8. The bypass duct 88 opens into the supply duct 80 and as a consequence delivers a cooler portion of the airstream to the supply duct 80, thus reducing the temperature of the airstream within the supply duct 80. The ducts 82, 84, 86, and 88 are all covered with thermal insulation Finally, the system exhaust 12 is connected to the discharge duct 82 through a recirculating duct 90, which is also part of the ducting, so as to recirculate some of the heated airstream back to the discharge duct 82 in order to elevate the temperature of the airstream in the cyclone collector 4. The duct 90 is also insulated so that the portion of the airstream circulated through it remains at elevated temperatures. The recirculating duct 90 opens out of the system exhaust 12 upstream from the mechanical damper 70. It contains its own motor-operated damper 91.

Turning now to the control of the system A, the control loop 16 includes a temperature sensor 92 which monitors the temperature of the airstream in the discharge duct 82 immediately beyond the charge hood 36. As such, the temperature sensor 92 lies upstream from the location at which the recirculating duct 90 opens into the discharge duct 82. Hence, the temperature sensor 92 monitors the temperature of the airstream as the airstream passes out of the kiln 2. In addition, the control loop 16 has a controller 94 which controls the speed of the motor for the circulation fan 6 in response to signals derived from the temperature sensor 92.

If the temperature detected by the sensor 92 rises above a set point, perhaps by reason of less scrap or more moisture in the kiln 2, the controller 94 decreases the speed of the fan 6 to decrease the mass flow of the airstream. The temperature of the airstream at the sensor 92 thus rises. On the other hand, if the sensor 92 detects a decrease in temperature below another set point, the controller 94 increases the speed of the fan 6, which increases the mass flow and the temperature of the airstream at the sensor 92.

The control loop 18 includes a temperature sensor 96, but it is located in the supply duct 80 at the discharge from the separator 68 and upstream from the location at which the bypass duct 88 opens into the supply duct 80. The control loop 18 also includes two control motors 98 and 100 which react to signals derived from the temperature sensor 96. The control motor 98 operates the valve 60 in the fuel line 50, whereas the control motor 100 operates the damper 62 in the branch 56 of the combustion air duct 54 that leads from the combustion blower 52. If the temperature of the airstream at the discharge from the afterburner 10, that is the temperature detected by the sensor 96, drops, the control motors 98 and 100, operating in unison, open the valve 60 and the damper 62 to admit more fuel and combustion air to the burner 48. The temperature of the airstream within the combustion chamber 46 rises, and this is reflected in a rise in the temperature of the airstream in the supply duct 80 ahead of the bypass duct 88. On the other hand, the control motors 98 and 100 respond to an increase in the temperature sensed by the sensor 96 by reducing the flow of fuel and combustion air to the burner 46. The object, of course, is to maintain the temperature at the entrance to the supply duct 80 generally uniform.

The control loop 20 contains an oxygen sensor 102 which monitors the oxygen content of the airstream in the supply duct 80 upstream from the bypass duct 88. The loop 20 also has a control motor 104 which operates the damper 64 in the combustion chamber branch 58 of the combustion air duct 54. The control motor 104 opens the damper 64 in response to a decrease in the oxygen content of the airstream at the discharge from the afterburner 10, and closes it in response to an increase in the oxygen content. Indeed, the control loop 20, by manipulating the combustion air damper 64, seeks to maintain the oxygen content of the airstream at the entrance to the supply duct 80, and elsewhere as well, at a set point, preferably in the range between 6% and 8%.

The ducting 14 confines the airstream and thus enables it to remain at a pressure slightly elevated over atmospheric. The setting of the mechanical damper 70 in the system exhaust 12 determines the pressure of the airstream, and the damper 70 operates under the control of the control loop 22. To this end, the loop 22 includes a pressure sensor 106 which is located in the supply duct 80 downstream from the bypass duct 88. In addition, the loop 22 has a controller 108 which controls the operation of the control motor 72 for the mechanical damper 70. The object is to maintain the pressure within the supply duct 80 at a set point. If the pressure detected by the sensor 106 rises above the set point, the controller 108 energizes the control motor 72 such that opens the damper 70 to decrease the pressure in the ducting 14. If the pressure at the sensor 106 drops below the set point, the controller 108 responds by causing the motor 72 to close the damper 70.

The control loop 26 maintains the temperature of the airstream where it enters the kiln 2 substantially constant. To this end, it includes a temperature sensor 110 which is located in the supply duct 80 immediately upstream from the discharge hood 34. Here the temperature of the airstream is essentially the same as the temperature at which the airstream initially encounters the scrap metal in the kiln 2. The loop 26 also has a control motor 112 which operates the diverter valve 8. If the temperature detected by the sensor 110 rises above the prescribed inlet temperature, the control motor 112 opens the valve 8 further and directs more of the relatively cool air in the return duct 84 into the bypass duct 88. This air mixes with the hotter air from the afterburner 10 to lower the temperature of the airstream in the region of the supply duct 80 leading to the kiln 2. On the other hand, if the temperature of the airstream at the entrance to the kiln 2 drops below a prescribed setting, the control motor closes the diverter valve 6. The object, of course, is to maintain the temperature at the charge hood 36 substantially constant at about 1100° F.

Sometimes the airstream does not possess enough heat to maintain the set point temperature at the discharge from the kiln 2, this being most likely to occur when the system A is first set into operation. With that temperature depressed, the volatilized coating that is carried by the airstream into the cyclone collector 4 may condense on the surfaces of the collector 4, a condition which is not desirable. The control loop 28 insures that the temperature of the airstream at the entrance of the cyclone collector 4 remains high enough to inhibit condensation. To this end, the control loop 28 has a temperature sensor 114 which is located in the discharge duct 82 at the entrance to the collector 4. It also includes a control motor 116 which operates the damper 91 in the recirculating duct 90. If the temperature of the airstream entering the cyclone collector 4 falls below a prescribed set point, the controller 116 opens the damper 91 in the recirculating duct 90 which recirculates hotter air from the system exhaust 12 into the discharge duct 82 and thereby elevates the temperature of the airstream in the discharge duct 82.

In the operation of the system A, the conveyor 40 delivers aluminum beverage cans or other aluminum scrap covered with an organic coating to the hood 36 at the one end of the kiln 2, from which it passes into the cylinder 32 of the kiln 2. The fragmented scrap, owing to the rotation of the cylinder 32, as well as to its inclination, tumbles through the cylinder 32, and in so doing migrates to the other end, the residence time for any particular fragment being on the order of 16 to 20 minutes. At that end, the fragmented scrap enters the other hood 34, through which it is removed from the system A.

During its residence time within the kiln 2, the fragmented scrap encounters the airstream which enters the kiln 2 at the discharge hood 34, where the scrap is discharged, and leaves at the charge hood 36 where the scrap enters. Thus, the airstream flows in the direction opposite to that of scrap, and the scrap reaches its highest temperature at the discharge hood 34. Since the temperature of the airstream within the supply duct 80 never exceeds 1100° F., the scrap within the kiln 2 never exceeds that temperature—and that temperature is below the melting temperature for the scrap, yet is above the temperature at which the coating volatilizes. Moreover, the airstream within the duct 30 has a reduced oxygen content, normally on the order of 6% to 8%, and at this rarefied level of oxygen most coatings normally found on aluminum, whether they be lacquer or simply oils, will not ignite, even at the highest temperature of the airstream within the kiln 2. The coating does volatilize and enter the airstream, and any solids which remain simply become entrained in the airstream as particulate matter. Of course, as the airstream flows over the scrap within the kiln 2, it, being hotter than the scrap, loses heat to the scrap and becomes cooler.

Within the afterburner 10, the airstream is heated to a substantially higher temperature due to the presence of the flame produced by the burner 48. Moreover, at the entrance to the afterburner 10 the airstream acquires a higher oxygen content due to the introduction of the air from the combustion air duct 54. The elevated temperature, together with the additional oxygen, provide an atmosphere suitable for combustion; that is, ignition of the volatile components of the coating. They are consumed and as a result are converted primarily into carbon dioxide and water. The combustion leaves the airstream again deficient in oxygen—indeed, reduces it oxygen content to the prescribed level of 6% to 8%.

Beyond the afterburner 10, some of the airstream is diverted to the atmosphere through the system exhaust 12, while the remainder is directed into the supply duct 80 that leads back to the kiln 2. But the temperature of the airstream, when it is discharged from the afterburner 10, exceeds the set point temperature at the entrance to the kiln 2 and is even hot enough to melt aluminum. Cooler air diverted from the return duct 86 at the diverter valve 6 flows through the bypass duct 88 and into the supply duct 80 where it reduces the temperature of the airstream in the portion of the supply duct leading to kiln 2. Indeed, the temperature sensor 110 for the control loop 26 detects the temperature of the airstream where it enters the kiln 2, and the control motor 112 regulates the diverter valve 8 so that enough of the cooled airstream is diverted into the bypass duct 88 and mixed with the much hotter portion of the airstream discharged from the afterburner 10 to maintain the prescribed temperature where the airstream enters the kiln 2.

While the temperature of the airstream entering the kiln 2 remains substantially constant at about 1100° F., the mass flow of the airstream does not. It varies to maintain a generally constant or uniform temperature gradient within the kiln 2 (FIG. 2). Whereas, the temperature of the airstream where it enters the kiln 2 is about 1100° F., the temperature where it leaves is about 500° F. To maintain the gradient, the controller 94 of the control loop 16, by regulating the speed of the motor for the circulation fan 6, controls the mass of the airstream passing into the kiln 2 at any given time. If the temperature of the airstream where it leaves the kiln 2 is too low, the mass flow is increased by slightly increasing the speed of the fan 6. On the other hand, if the temperature is too great, the speed of the fan 6 is reduced.

Were it not for the control loop 16 and its ability to regulate the mass flow of the airstream within the kiln 2, conditions would vary substantially within cylinder 32 of the kiln 2, because it is virtually impossible to maintain any uniformity in the fragmented scrap. First of all, the scrap does not pass uniformly through the kiln 2, that is to say the mass of scrap within the kiln 2 will vary, indeed substantially, from time to time. Of course, the mass of scrap within the kiln 2, to a large measure, determines the amount of heat extracted from the airstream passing through the kiln 2; the greater the mass of the scrap, the more heat extracted. Aside from that, the scrap may contain moisture, particularly if it constitutes expended beverage cans, and water, of course, requires considerable energy to convert to its vapor phase. The amount of moisture may vary considerably, and thus the heat extracted from the airstream also depends on the amount of moisture that is within the scrap in the kiln 2.

Thus, the temperature of the airstream at the end of the kiln 2 where the airstream enters the kiln 2, remains constant, at about 1100° F., and likewise the temperature of the airstream at the end of the kiln 2, where the airstream leaves the kiln 2, likewise remains constant at about 500° F., irrespective of the mass of the scrap within the kiln 2 or the amount of moisture in that scrap. The system A responds to variations in the condition of the scrap by varying the mass flow of the airstream through the kiln 2, that is, the mass flow past any given point in the kiln 2 for a given unit of time. At any location within the cylinder 32 of the kiln 2, the temperature of the scrap never quite reaches the temperature of the airstream, but always remains slightly below it. Even at the discharge hood 34, where the temperature of the airstream is at its highest, the airstream is not hot enough to melt the scrap.

While the temperature of the airstream exceeds the combustion temperature of the volatile components in most coatings, the coatings do not ignite, because the control loop 20 senses the oxygen content of the airstream entering the kiln 2 and regulates it so that it remains between 6% and 8%, which is below that required to sustain combustion. As a consequence, the volatile components merely volatilize and become part of the airstream, while the solid components drop off as particulates which become entrained in the airstream. The cyclone collector 4 thereafter extracts most of these solid components from the airstream before the airstream enters the circulation fan 6 and the afterburner 20.

This invention is intended to cover all changes and modifications of the example of the invention herein chosen for purposes of the disclosure which do not constitute departures from the spirit and scope of the invention

What is claimed is:

1. An apparatus for removing a coating, which volatilizes at elevated temperatures, from metal fragments, said apparatus comprising: a kiln having a first end where metal fragments enter the kiln and a second end where metal fragments leave the kiln; ducting connecting the ends of the kiln and arranged generally in a loop; a fan connected with the ducting for establishing an airstream which flows through the ducting and through the kiln; an afterburner connected with the ducting such that it heats the airstream to elevate the temperature of the airstream, so that the airstream enters the kiln at an elevated temperature, the ducting including a bypass duct which bypasses the afterburner so that some of the airstream may recirculate through the kiln without passing through the afterburner, whereby the temperature of the airstream entering the kiln is less than the temperature of the portion of the airstream that leaves the afterburner; a first temperature sensor for monitoring the temperature of the airstream entering the kiln; and a diverter valve located in the ducting such that it controls the amount of air passing through the bypass duct and thus modulates the temperature of the airstream entering the kiln, the diverter valve responding to the first temperature sensor such that it allows more of the airstream to pass through the bypass duct when the temperature of the airstream entering the kiln exceeds a prescribed inlet temperature and allows less of the airstream to pass through the bypass duct when temperature of the airstream entering the kiln falls below a prescribed inlet temperature.

2. An apparatus according to claim 1 and further comprising a second temperature sensor for monitoring the temperature of the airstream leaving the kiln; and wherein the fan responds to the second temperature sensor such that it decreases the mass flow of the airstream where the temperature of the airstream leaving the kiln rises above a prescribed outlet temperature and increases the mass flow when the temperature of the airstream leaving the kiln falls below a prescribed outlet temperature.

3. An apparatus according to claim 2 wherein the prescribed inlet temperature is high enough to volatilize the coating in the kiln; and wherein the volatilized coating becomes entrained in the airstream.

4. An apparatus according to claim 3 wherein the ducting comprises at least one discharge duct which extends between the end of the kiln at which the airstream leaves the kiln and the fan; a return duct that extends between the fan and the afterburner such that the airstream is directed from the return duct into the afterburner, and a supply duct which is connected to the afterburner such that the airstream after being heated in the afterburner enters the supply duct, the supply duct extending between the afterburner and the end of the kiln at which the airstream enters the kiln; and wherein the bypass duct extends between the return duct and the supply duct.

5. An apparatus according to claim 4 and further comprising a system exhaust in communication with the afterburner for venting a portion of the airstream after it is heated by the afterburner, the system exhaust including a first damper which controls the amount of the airstream that is vented.

6. An apparatus according to claim 5 and further comprising a pressure sensor in the supply duct for monitoring the pressure of the airstream upstream from the kiln; and wherein the damper responds to the pressure sensor, opening it when the pressure exceeds a prescribed pressure and closing when the pressure drops below a prescribed pressure.

7. An apparatus according to claim 6 and further comprising a collector connected to the discharge duct and configured to cause particulates in the airstream to drop out of the airstream and accumulate; and wherein the ducting further includes a recirculating duct connected between the system exhaust and the discharge duct at a location upstream from the collector, whereby heated air that is directed through the recirculating duct and into the discharge duct elevates the temperature of the airstream entering the collector.

8. An apparatus according to claim 7 and further comprising a third temperature sensor in the discharge duct for monitoring the temperature of the airstream entering the collector, and a second damper in the recirculating duct, the second damper being responsive to the third temperature sensor such that it opens when the airstream entering the collector falls below a prescribed temperature.

9. An apparatus according to claim 8 wherein the supply duct is connected to the second end of the kiln and the discharge duct is connected to the first end, whereby the metal fragments and airstream move through the kiln in opposite directions.

10. An apparatus for removing, from metal scrap, a coating which volatilizes at elevated temperatures, said apparatus comprising: a kiln having a first end and a second end, the kiln receiving the scrap with the coating on it at one end and discharging it at the other end; a fan for generating an airstream, the fan having a suction port and a discharge port; at least one discharge duct connecting the first end of the kiln with the suction port of the fan; an afterburner having a combustion chamber and an inlet opening into the combustion chamber and an outlet opening out of the combustion chamber, the afterburner also having a burner for producing a flame in the combustion chamber to ignite the coating in a volatilized condition in the combustion chamber; a return duct connecting the discharge port of the fan with the inlet of the afterburner; a supply duct connecting the outlet of the afterburner with the second end of the kiln, whereby the fan when energized circulates an airstream through the return duct, the afterburner, the supply duct, the kiln and the discharge duct in that order from the fan and back to the fan; a bypass duct connected between the return duct and the supply duct, so that the portion of the airstream that passes through it reduces the temperature of the airstream entering the kiln from the supply duct; a first temperature sensor for monitoring the temperature of the airstream entering the kiln; and a diverter valve responsive to the first temperature sensor for controlling the portion of the airstream passing through the bypass duct so as to control the temperature of the airstream entering the kiln and maintaining it substantially constant.

11. An apparatus according to claim 10 and further comprising a second temperature sensor for monitoring the temperature of the airstream leaving the kiln; and wherein the fan responds to the second temperature sensor to vary the mass flow of the airstream such that the temperature of the airstream leaving the kiln remains substantially constant.

12. An apparatus according to claim 10 and further comprising a collector in the discharge duct for causing particulates to leave the airstream and accumulate; a recirculating duct communicating with the outlet of the combustion chamber for the afterburner and opening into the discharge duct upstream from the collector; a third temperature sensor for monitoring the temperature of the airstream entering the collector; and a damper in the recirculating duct and responding to the third temperature sensor such that it prevents the temperature of the airstream entering the collector from dropping below a prescribed temperature by directing hotter portions of the airstream into the discharge duct.

* * * * *